US005962977A

United States Patent [19]

Matsumoto et al.

[11] Patent Number: 5,962,977

[45] Date of Patent: Oct. 5, 1999

[54] LOW PRESSURE DISCHARGE LAMP HAVING ELECTRODES WITH A LITHIUM-CONTAINING ELECTRODE EMISSION MATERIAL

[75] Inventors: Keiichi Matsumoto, Tatsuno; Yukiharu Tagawa; Toyohiko Kumada, both of Himeji; Makoto Fujii, Takasago; Akiko Hata, Kakogawa, all of Japan

[73] Assignee: Ushiodenki Kabushiki Kaisha, Tokyo, Japan

[21] Appl. No.: 08/994,938

[22] Filed: Dec. 19, 1997

[30] Foreign Application Priority Data

Dec. 20, 1996 [JP] Japan ..... 8-340936

[51] Int. Cl.[6] ..... H01J 61/067; H01J 1/14

[52] U.S. Cl. ..... 313/633; 313/346 R; 313/345; 313/355; 313/491

[58] Field of Search ..... 313/633, 634, 313/341, 345, 355, 352, 491, 346 DC, 346 R

[56] References Cited

U.S. PATENT DOCUMENTS

| | | | |
|---|---|---|---|
| 3,656,020 | 4/1972 | Cronin | 313/311 |
| 4,314,175 | 2/1982 | Jacobs | 313/552 |
| 5,256,935 | 10/1993 | Dobashi et al. | 313/634 |
| 5,581,152 | 12/1996 | Matsuno et al. | 313/634 |

FOREIGN PATENT DOCUMENTS

| | | |
|---|---|---|
| 5-3016 | 2/1993 | Japan . |
| 8-227692 | 9/1996 | Japan . |

*Primary Examiner*—Sandra O'Shea
*Assistant Examiner*—Joseph Williams
*Attorney, Agent, or Firm*—Sixbey, Friedman, Leedom & Ferguson; David S. Safran

[57] ABSTRACT

A low pressure discharge lamp in which, even during uninterrupted operation, a low lamp voltage characteristic is maintained over a long time interval and in which high radiant efficiency can be obtained over a long time is achieved via a low pressure discharge lamp which has a tubular glass bulb in which a pair of electrodes are located opposite one another, by an electron emission material which contains lithium being included on or in the electrode substrate. Advantageously, the electron emission material contains at least one of the following materials: metallic lithium, an alloy of lithium and another metal, an oxide of lithium, a mixture of an oxide of lithium with another metal oxide, and an oxide which contains lithium and another metal element and which is a compound identified by the formula Li—M—$O_x$ where M designates at least one element selected from among the alkali earth metals, rare earth metals and transition metal, and x is the number of oxygen atoms required for valency equalization.

3 Claims, 2 Drawing Sheets

LOW PRESSURE DISCHARGE LAMP HAVING ELECTRODES WITH A LITHIUM-CONTAINING ELECTRODE EMISSION MATERIAL

BACKGROUND OF THE INVENTION

1. Field of the Invention

The invention relates to a low pressure discharge lamp, and especially to a low pressure discharge lamp which is used for backlighting of a liquid crystal display device, for a light source for a scanning device, for a light source for purposes of general illumination, for a UV light source and the like.

2. Description of Related Art

Recently liquid crystal display devices have been used in various areas. For backlighting of liquid crystal display devices, fluorescent lamps which are a type of low pressure discharge lamp have been used to advantage.

Furthermore, low pressure discharge lamps have also been used recently for the light source of a scanning device, a UV light source, and the like.

Low pressure discharge lamps are divided into so-called low pressure discharge lamps of the hot cathode type, in which mainly the phenomenon of thermal electron emission is used, and into so-called low pressure discharge lamps of the cold cathode type, in which mainly the phenomenon of secondary electron emission is used. The low pressure discharge lamps of the cold cathode type have no luminous filaments for heating, and the operating temperature (temperature during operation) of its electrodes is less than or equal to roughly 700 K. On the other hand, the operating temperature of the electrodes of low pressure discharge lamps of the hot cathode type is, for example, roughly 1000 K. The operating temperature of the electrodes of short arc discharge lamps which are not considered to be low pressure discharge lamps reaches roughly 2500 K.

However, in the low pressure discharge lamps of the cold cathode type, the cathode drop voltage during operation (the potential difference in the middle area between the electrode surface and the positive column (plasma)) is large, for example, greater than or equal to 120 V, if their electrodes are not provided with electron emission material. As is apparent therefrom, the disadvantage arises that the portion of the total power consumed in the entire lamp which is constituted by the power consumed by the electrodes themselves, i.e. the power which does not contribute to emission, is large, and as a result, the radiant efficiency with respect to power consumption is low.

Therefore, there are cases in which, even in low pressure discharge lamps of the cold cathode type, the electrodes are provided with electron emission material. In this case, as in the electrodes of low pressure discharge lamps of the hot cathode type or the like, electron emission material which is comprised primarily of barium (Ba) and the like is applied to the surface of the metal electrode substrate by coating or burning in. In the case in which the electrode substrate is provided with electron emission material, due to the presence of this electron emission material, the cathode drop voltage is, for example, roughly 60 V. This reduces the power consumption on the electrodes and the radiant efficiency with respect to power consumption is therefore increased.

However, the electron emission material, such as barium or the like, often sprays due to sputtering by ions and electrons which form in the glass bulb. In the case of uninterrupted operation of these lamps, therefore, the above described electron emission material disappears within a few hundred hours after starting operation. The radiant efficiency drops accordingly, and as a result, a low pressure discharge lamp cannot obtained in which high radiant efficiency is obtained over a long time.

SUMMARY OF THE INVENTION

Therefore, a primary object of the present invention is to devise a low pressure discharge lamp in which, even during uninterrupted operation, the operating characteristics of a low lamp voltage can be maintained over a long time interval and in which high radiant efficiency can be obtained over a long time.

This object is achieved, according to the invention, in a low pressure discharge lamp which has a tubular glass bulb in which a pair of electrodes are located opposite one another, by an electron emission material which contains lithium being included on or in the electrode substrate of the electrodes.

The object of the invention is furthermore advantageously achieved by the electron emission material which contains lithium being applied to the surface of the above described electrode substrate.

The object of the invention is moreover advantageously achieved by the electrode substrate being porous and impregnated with the electron emission material which contains lithium.

The object of the invention is still further advantageously achieved by the electrode substrate being formed by sintering the material of which it is composed, i.e. the base material of the electrodes, together with the electron emission material which contains lithium.

The object of the invention is moreover advantageously achieved by the electron emission material containing at least one of the following materials: metallic lithium, an alloy of lithium and another metal, an oxide of lithium, a mixture of an oxide of lithium with another metal oxide, and an oxide which contains lithium and another metal element and which is a compound identified by the formula Li—M—$O_x$ (here M designates at least one element selected from among the alkali earth metals, rare earth metals and transition metals, and x is the number of oxygen atoms required for valency equalization).

The object of the invention is furthermore advantageously achieved by the glass bulb being filled with a rare gas, or a rare gas together with mercury, and by the filling pressure being a total of 0.5 to 30 kPa.

The object of the invention is also advantageously achieved by a given material being used for hermetic sealing. This measure can prevent leakage of the added gas.

These and further objects, features and advantages of the present invention will become apparent from the following description when taken in connection with the accompanying drawings which, for purposes of illustration only, show several embodiments in accordance with the present invention.

BRIEF DESCRIPTION OF THE INVENTION

DETAILED DESCRIPTION OF THE PREFERRED EMBODIMENTS

Figure 1:
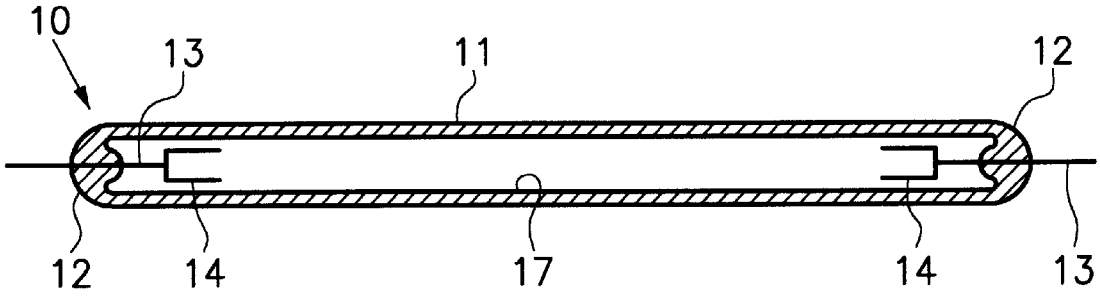
FIG. 1 shows a schematic cross section of the arrangement of one embodiment of the low pressure discharge lamp of the present invention.

FIG. 1 schematically shows one example of a low pressure discharge lamp 10 in accordance with the present invention which is used as a small fluorescent lamp. The pressure discharge lamp is comprised of a rod-shaped, tubular glass bulb 11 with an inside diameter that is, for example, less than or equal to 10 mm, and each of the two opposite ends of which is formed with a hermetically sealed portion 12. Electrical lead lines 13, 13 penetrate these hermetically sealed portions 12, 12, which hermetically surround them, and extend in the axial direction of the glass bulb 11. Furthermore, the inner end of each of these lines 13, 13 is provided with an electrode 14, the pair of electrodes arranged opposite one another in the axial direction of glass bulb 11. Furthermore, a fluorescent body layer 17 with a thickness of, for example, 10 to 30 microns is formed on the inner peripheral surface of the glass bulb 11. The glass bulb 11 is filled with mercury and a rare gas.

Figure 2:
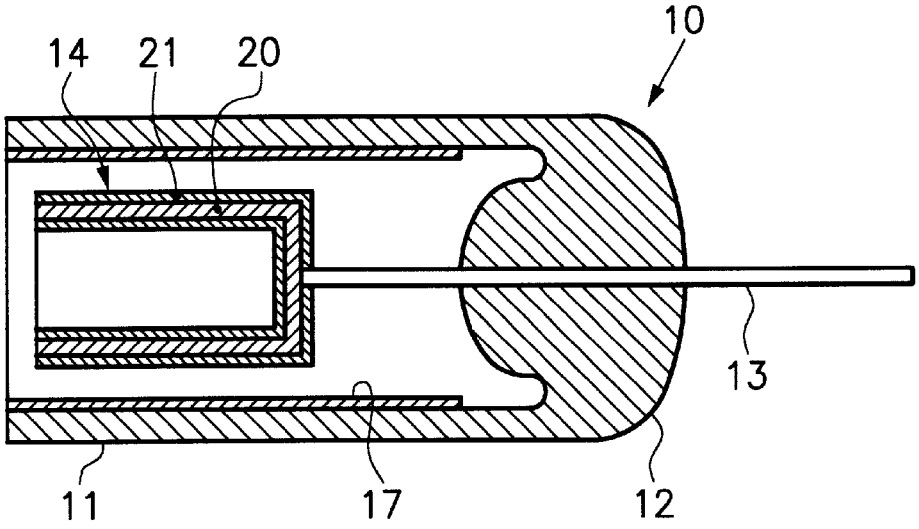
FIG. 2 is an enlarged schematic cross section of the portion of the low pressure discharge lamp of FIG. 1 containing one of the two electrodes.

For electrode 14, as is shown schematically in FIG. 2, on the entire surface of electrode substrate 20, with the exception of the connection area to line 13, an electron emission material layer 21 which contains lithium, is applied or deposited by coating or burning-in, electrode substrate 20 being formed by shaping a plate-like metal into a cylindrical sleeve with a bottom; but, the shape of electrode substrate 20 of electrode 14 is not limited to that shown. For example, the sleeve shape can be further processed into suitable shapes, such as into the shape of strips or the like, or rod-shaped metal can be used. However, it is advantageous to use the sleeve shape, because a large surface can be ensured on which the electron emission material is applied.

Furthermore, any conventional electrode material can be used for the material of electrode substrate 20. With respect to high efficiency of secondary electron emission, low sputtering and low gas emission, it is, for example, especially advantageous to use iron, an alloy of iron, such as stainless steel or the like, nickel or a nickel alloy.

In the low pressure discharge lamp of the invention, electrode 14 itself does not primarily emit thermal electrons. Nor does electrode 14 have any luminous filament which emits thermal electrons. This means that, in the low pressure discharge lamp of the invention, electrode 14 emits secondary electrons by receiving ion or electron impacts or the like from the opposite electrode. This phenomenon of secondary electron emission becomes the main cause of discharge, and thus, the discharge is maintained. This means that it is a low pressure discharge lamp of the cold cathode type.

In the case of an electrode for emission of thermal electrons which is provided with a luminous filament for purposes of heating, this electrode conversely reaches a high temperature; this causes more vigorous transpiration of the electron emission material which contains lithium. As a result, the applied electron emission material disappears prematurely. Therefore, the object of the invention cannot be achieved in practice.

It is advantageous that the electron emission material which forms electron emission material layer 21 and which contains lithium is formed of at least one of the following materials: metallic lithium (Li), an alloy of lithium and another metal, an oxide of lithium ($Li_2O$), a mixture of an oxide of lithium and another metal oxide, and an oxide which contains both lithium and also another metal and is a compound identified by the formula Li—M—$O_x$ (combined oxide) where M designates at least one metal element which is selected from among alkali earth elements, rare earth elements and transition metals. Specifically, the following can be given for M:

Be, Mg, Ca, Sr and Ba can be named as alkali earth metals.

Y, La, Ce, Pr, Nd, Sm, Eu, Gd, Tb, Dy, Ho, Er, Tm, Yb and Lu can be named as rare earth metals.

Sc, Ti, V, Cr, Mn, Fe, Co, Ni, Cu, Zn, Y, Zr, Nb, Mo, Tc, Ru, Rh, Pd, Ag, Cd, Hf, Ta, W, Re, Os, Ir, Pt and Au can be named as transition metals.

In this case, especially, Sr, Ca, Zr, Ni and the like are advantageous because they have the action of suppressing vaporization of lithium and sputtering, and because they can be easily handled in the production of the lamp.

If a mixture of an oxide of lithium with another metal oxide or a combined oxide which contains lithium is used as the electron emission material, as a result of the stable state in which the lithium oxide is present, vaporization within the glass bulb is suppressed. Therefore, this is advantageous because, as the result thereof, the action of simplifying electron emission is developed over a long time.

In the invention, it is advantageous that the lithium content is high in the electron emission material layer 21. For example, in the case of an electron emission material which is formed of a mixture with another metal oxide or an oxide combined with another metal, it is advantageous that the ratio of the lithium content to the total metal content of the lithium together with the other metal element is, for example, greater than or equal to 10% by mole, especially greater than or equal to 30% by mole. In the case in which this ratio is less than 10% by mole, the amount of reduction of the cathode drop voltage becomes less.

The means for applying the electron emission material which contains lithium to the surface of the electrode substrate is not limited. For example, electron emission material layer 21 can be formed by the sputtering evaporation method, the vacuum evaporation method, and the like.

In the case of using an oxide of lithium, a mixture of an oxide of lithium with another metal oxide or a combined oxide of lithium and another metal as the electron emission material, for example, a process can be used in which powders of these materials are dispersed into a suitable liquid dispersion medium consisting of an organic solvent, a slurry of the electron emission material is produced, it is applied to the surface of the electrode substrate and subjected to heat treatment.

Specifically, a composition which is obtained, for example, by mixing lithium oxide, strontium oxide, calcium oxide and zirconia in a suitable ratio is mixed with a suitable organic solvent, yielding a slurry. The latter is applied to the surface of the electrode substrate in a suitable deposition amount and then subjected to heating at a temperature of, for example, 800 to 1200° C. in a hydrogen gas atmosphere or in a vacuum. Thus, the electron emission material which contains lithium oxide can be located on the surface of the electrode substrate.

Furthermore, in this process which includes heat treatment, a suitable compound which produces lithium oxide by this heat treatment, such as, for example, a carbonate of lithium, hydroxide of lithium and the like, can be used as the raw material. In this case, this raw material compound is decomposed or oxidized by the described heat treatment, and in this way, lithium oxide is produced. Additionally, depending on the conditions in the production, lithium oxide, as such, can be used from the start.

In the invention, the amount of electron emission material applied or deposited on the surface of the electrode substrate can be selected to be different according to the type of electron emission material or the like. For example, an amount applied per unit of area of the surface of the electrode substrate is 0.1 to 5 mg/cm$^2$. The thickness of electron emission material layer 21 is, for example, roughly 0.1 to 10 microns.

Furthermore, it is advantageous that the area of the surface of the electrode substrate on which the electron emission material is applied comprises the entire area in which the formation of secondary electron emission is possible, i.e. the entire surface of the electrode substrate. The invention is, however, not limited thereto.

In accordance with the invention, the electrode substrate can also be porous. Preferably then, the porous electrode substrate is impregnated with an electron emission material. In this way, the applied amount of electron emission material can be increased as compared to the case of forming the electron emission material only on the outer surface of the electrode substrate.

Furthermore, by depositing the electron emission material within the pores, where wear is less than wear of the electron emission material on the outer surface, wear of the electron emission material can be suppressed overall. As a result, the operating service life can be prolonged at a low cathode drop voltage. Specifically, the main component of the electrode substrate metal is a transition metal, such as iron, nickel or the like, or a metal with a high melting point, such as tungsten, molybdenum or the like.

The electrode substrate can also be formed in accordance with the invention by sintering the material of which the electrode substrate is to be made (i.e. the base material of the electrode) together with the electron emission material which contains lithium.

It is advantageous in the invention that, for example, lead glass, Kovar glass or borosilicate glass be used for glass bulb 11 of the low pressure discharge lamp. In this way, adequately high strength can be obtained even if the inside diameter of the glass bulb is, for example, less than or equal to 10 mm.

Furthermore, Kovar, tungsten, dumet wire which consists of a core wire of a nickel alloy coated with copper, or the like can be used for the electrical lead lines 13. In the case of producing glass bulb 11 from lead glass, it is advantageous to use dumet wire. Furthermore, in the case of producing glass bulb 11 from Kovar glass, it is advantageous to use Kovar.

The coefficient of thermal expansion of dumet wire is extremely close to that of lead glass, while that of Kovar is extremely close to that of Kovar glass. Therefore, glass bulb 11 and lines 13 can be sealed directly to one another in a highly sealed state. It is, therefore, unnecessary to undertake a special arrangement for hermetic sealing. In this way, hermetically sealed portions 12 can be advantageously produced even if the inside diameter of glass bulb 11 is, for example, less than or equal to 10 mm.

In the above described low pressure discharge lamp, glass bulb 11 is filled with a rare gas or a rare gas together with mercury. The fill pressure, overall, is preferably 0.5 to 30 kPa. Here, as the rare gas at least one gas is used which is chosen from among neon, argon, krypton and xenon. It is advantageous to use neon and argon as the main components. It is especially advantageous for the ratio of neon to the total rare gas to be 50 to 95% by mole. By satisfying these conditions, a small fluorescent tube with a low starting voltage and high radiance can be obtained.

If in the low pressure discharge lamp the fill pressure of the added rare gas and the like is less than 0.5 kPa overall, heavy wear of the electron emission material by sputtering takes place and its action is lost prematurely. On the other hand, in the case in which the above described fill pressure is greater than or equal to 30 kPa, the start voltage of the lamp is increased and the radiant efficiency is reduced. The two cases are thus undesirable.

There are cases in which it is advantageous to add mercury besides the rare gas to glass bulb 11. In this case, the fill amount of mercury is, for example, 1–10 mg per glass bulb. It is not, however, limited thereto and corresponds to the inside volume of the glass bulb.

The low pressure discharge lamp of the invention can furthermore be made as a fluorescent lamp. In this case, a fluorescent body layer 17 is formed on the inside of glass bulb 11. A layer known from the prior art can be used as such for this fluorescent body layer 17.

As becomes apparent below from one embodiment, in the low pressure discharge lamp of the invention, the lithium-containing electron emission material is applied to the surface of the electrode substrate which forms its electrodes. In the above described electrodes, therefore, the phenomenon of secondary electron emission easily occurs by means of the lithium-containing electron emission material. As a result, at a low operating temperature of, for example, 700 K in the cold cathode type, the desired emission can be obtained. The electrodes are not in the superheated state. Therefore, the above described electron emission material which contains lithium is prevented from spraying. In this way, the action of the electron emission material is maintained over a long time. Consequently, high radiant efficiency can be obtained over a long time.

Furthermore, in the low pressure discharge lamp as claimed in the invention a more advantageous action can be obtained by the arrangement described below:

At an inside diameter of the glass bulb of less than or equal to 10 mm, passage areas of the lines 13 on the outside of the hermetically sealed portions are each surrounded with a ceramic or resin heat-resistant material for purposes of hermetic sealing. Furthermore, the lines are attached by ceramic or resin components with high mechanical strength over these materials. This suppresses leaking of the added gas which occurs as a result of detachment of the oxide layers from the hermetically sealed portions. Thus, the sealing action of the hermetically sealed portions can be increased.

Figure 4:
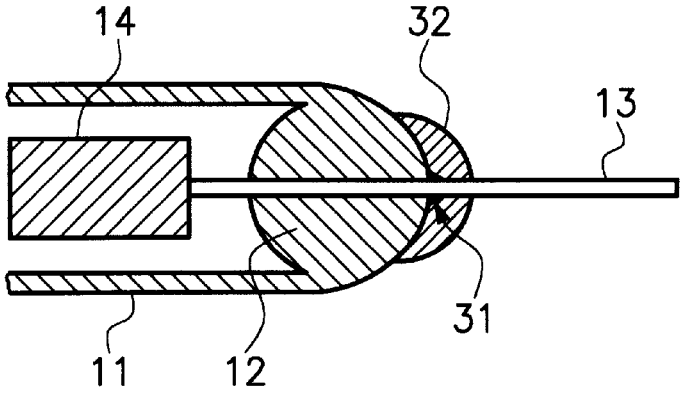
FIG. 4 is a view like that of FIG. 2, but of another embodiment of the invention.

In FIG. 4, on hermetically sealed portion 12, ceramic or resin heat-resistant material 31 was allowed to solidify for purposes of hermetic sealing such that the passage area of line 13 is jacketed to intensify the sealing action.

Furthermore, this material 31 is subjected to solidification by drying for purposes of hermetic sealing. Then, a component 32 of ceramic or resin with high mechanical strength is applied over the material 31 in order to hermetically seal this region. In this way, the tension which is exerted on hermetically sealed portion 12 when line 13 bends in the vicinity of the hermetically sealed portion is reduced. Thus, the mechanical strength is increased.

Electrical lead lines 13 project into the ambient atmosphere from hermetically sealed portions 12 of glass bulb 11. If, for example, dumet wires are used as lines 13, on the surfaces of the dumet wires, oxide layers (Cu(I) oxide: $Cu_2O$) are formed which join to the glass and which maintain the sealing action of the glass bulb. But, there are cases in which these oxide layers absorb water contained in the ambient atmosphere, are further oxidized and become layers of Cu(II) oxide, and detach. In the case of a relatively large diameter of glass bulb 11 (for example larger than 10 mm), the hermetically sealed portions can also have a high thickness in the axial direction of the tube. Therefore, no leak fault occurred when the oxide layers detached. In a discharge lamp with an inside diameter of glass bulb 11 of less than or equal to 10 mm, however, due to the low thickness of hermetically sealed portions 12 in the axial direction of the tube, when the oxide layers detach, proceeding from these sites, leaking of the glass bulb occurs which is equivalent to a defect of the discharge lamp.

For heat-resistant material 31, for purposes of hermetic sealing, silicone resin, acrylic-based resin, epoxy-based resin or ceramic, glass with a low melting point or the like, is used. The temperature of the above described discharge lamp rises a maximum to roughly 200° C. It is, therefore, a good idea to use material which neither softens nor melts at 200° C. for purposes of hermetic sealing.

In the following, the invention is described specifically using several embodiments.

(Embodiment 1)

According to the arrangement shown in FIG. 1 and under the following conditions low pressure discharge lamp 10 was produced.

(Glass bulb 11)
Material: lead glass
Dimensions: Total length of 70 mm,
Outside diameter of 2.6 mm,
Inside diameter of 2.0 mm
(Line 13)
Material: Dumet wire, outside diameter of 0.35 mm
(Electrode 14)
Electrode substrate 20: Shape: sleeve shape with bottom and an open tip,
Material: stainless steel
Dimensions: Total length of 4 mm
Outside diameter of 1.6 mm
Inside diameter of 1.2 mm
Electron emission material: lithium oxide
(Fluorescence body layer 17)
Material: Three-wave fluorescent body thickness of 15 microns
(Material to be added)
Gas to the be added: mixed gas of neon and argon (composition ratio:
neon/argon=90% by mole/10% by mole)
fill pressure: 1.06 kPa (80 torr)
Mercury: filling amount of 2 mg In this case the electron emission material of the electrodes is produced and applied as follows:

Lithium carbonate ($Li_2CO_3$) powder is mixed with butyl acetate as the organic solvent. Then, by adding a suitable amount of nitrocellulose, the viscosity is adjusted and a slurry produced. This slurry of electron emission material is applied to the entire surface including the outer peripheral surface and the inner peripheral surface of the electrode substrate. Then, heat treatment is performed in a hydrogen gas atmosphere at a temperature of roughly 900° C., lithium carbonate being decomposed in the heat and lithium oxide being produced. The applied amount is roughly 0.8 mg/cm$^2$.

(Measurement of the lamp voltage characteristic)

Figure 3:
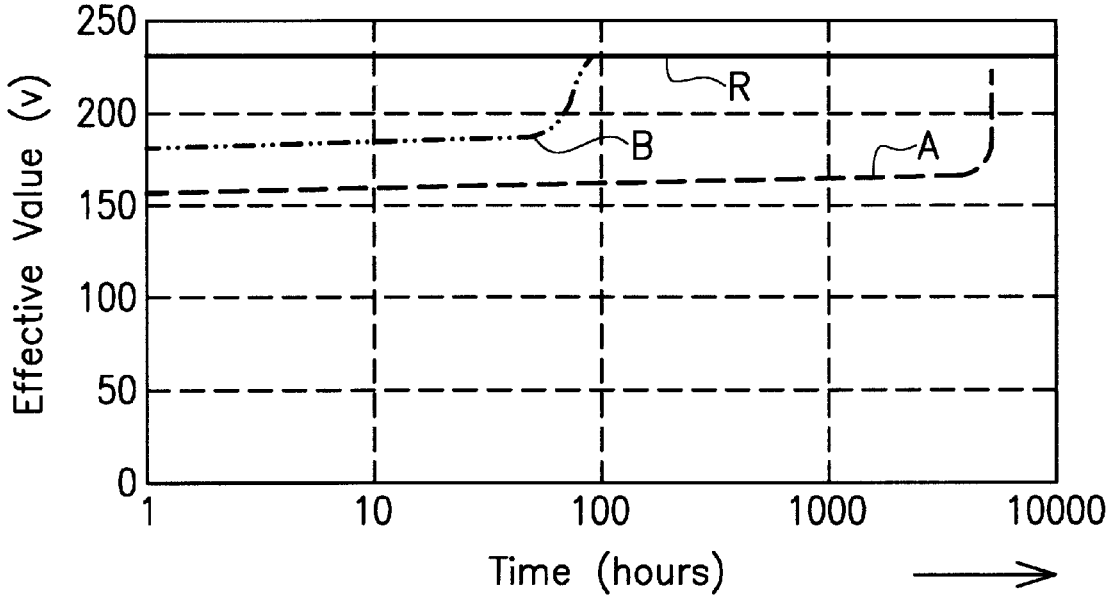
FIG. 3 is a graph of the characteristic curves which represent the change of the lamp voltage of the low pressure discharge lamp of the invention over time and the lamp voltage characteristic of low pressure discharge lamps in a contrast example and a comparison example.

The above described low pressure discharge lamp was subjected to uninterrupted operation with a lamp current of 5 mA by means of a constant circuit and a high-frequency circuit of 40 kHz, and changes of the lamp voltage over time were studied. Curve A (broken line) in FIG. 3 shows the result. The lamp voltage at the start of uninterrupted operation of this low pressure discharge lamp is about 155 V (effective value). Essentially, the same voltage characteristic was maintained until the duration of uninterrupted operation exceeded 5000 hours. The electrode operating temperature was roughly 500 K.

CONTRAST EXAMPLE 1

On the other hand, a low pressure discharge lamp was produced, for purposes of a contrast, in which, apart from using electrodes which are not provided with the electron emission material, the same arrangement as in above described embodiment 1 was accomplished. The same test of uninterrupted operation was performed and the lamp voltage characteristic was studied. FIG. 3 shows the result using curve R (solid line). The lamp voltage at the start of uninterrupted operation was roughly 230 V (effective value).

COMPARISON EXAMPLE 1

Furthermore, a low pressure discharge lamp was produced for comparison purposes, in which besides using barium carbonate instead of lithium carbonate, the same arrangement was produced as in above described embodiment 1. The same test of uninterrupted operation was performed by means of a constant circuit as well as by a high frequency circuit and the lamp voltage characteristic was studied. FIG. 3 shows the result using curve B (dashed line). The lamp voltage at the start of uninterrupted operation was roughly 175 V (effective value). At a duration of uninterrupted operation of longer than 80 hours, the lamp voltage rose considerably. After 100 hours the same characteristic as in the low pressure discharge lamp in contrast example 1 was obtained.

(Embodiment 2)

According to the arrangement shown in FIG. 1 and under the following conditions, low pressure discharge lamp 10 was produced.

(Glass bulb 1)
Material: lead glass
Dimensions: Total length of 70 mm,
Outside diameter of 2.6 mm,
Inside diameter of 2.0 mm
(Line 13)
Material: Dumet wire, outside diameter of 0.35 mm
(Electrode 14)
Electrode substrate 20: Shape: sleeve shape with bottom and an open tip,
Material: stainless steel
Dimensions: Total length of 4 mm
Outside diameter of 1.6 mm
Inside diameter of 1.2 mm
Electron emission material: lithium oxide, strontium oxide, mixture of calcium oxide and zirconia
(Fluorescent body layer 17)
Material: Three-wave fluorescent body thickness of 15 microns
(Material to be added)
Gas to the added: mixed gas of neon and argon (composition ratio:
neon/argon=90% by mole/10% by mole)

fill pressure: 1.06 kPa (80 torr)

Mercury: filling amount of 2 mg

Here, the electron emission material of the electrodes is produced and applied as follows:

A powder mixture of lithium oxide ($Li_2O$) with a proportion of 30 to 50% by weight, strontium oxide (SrO) with a proportion of less than or equal to 30% by weight, calcium oxide (CaO) with a proportion of less than or equal to 30% by weight, and zirconia ($ZrO_2$) with a proportion of less than or equal to 5% by weight is mixed with butyl acetate as the organic solvent. Then, by adding a suitable amount of nitrocellulose, the viscosity is adjusted and a slurry produced. This slurry of electron emission material is applied to the entire surface including the outer peripheral surface and the inner peripheral surface of the electrode substrate. Heat treatment is performed in a hydrogen gas atmosphere at a temperature of roughly 1000° C., a mixture of metal oxides being produced. The applied amount is roughly 1 mg/cm$^2$.

(Measurement of the lamp voltage characteristic)

In the above described low pressure discharge lamp, changes of lamp voltage over time were studied as in embodiment 1. The lamp voltage at the start of uninterrupted operation is roughly 150 V (effective value). Essentially the same voltage characteristic was maintained until the duration of uninterrupted operation exceeded 7000 hours. The electrode operating temperature was roughly 500 K.

As becomes apparent below, from the above described embodiment, in the low pressure discharge lamp of the invention with electrodes in which the electron emission material is applied to the surface of the electrode substrate, the lamp voltage at the start of uninterrupted operation is low. Furthermore, the characteristic of one such low lamp voltage is maintained over an extremely long time and high radiant efficiency can be obtained over a long time.

(Embodiment 3)

In the low pressure discharge lamp according to embodiment 1 only the electrodes are changed. The electrode substrate is produced by press molding of nickel powder with a stipulated shape and by sintering thereof. The electron emission material is produced as follows:

Lithium carbonate ($LI_2CO_3$) powder is mixed with butyl acetate as the organic solvent. Then, by adding a suitable amount of nitrocellulose the viscosity is adjusted and a slurry produced which is applied to the porous surface of the substrate metal. These electrodes are heat treated in a hydrogen atmosphere at a temperature of roughly 1000° C., lithium carbonate being decomposed in the heat. In this way, lithium oxide is produced and melted at the same time. The porous surface and the inside of the substrate metal are impregnated with the electron emission material. The applied amount is roughly 3 mg/cm$^2$. The condition under which impregnation is performed is not limited to the above described condition. Impregnation can also be produced in an nitrogen atmosphere or at a pressure of less than or equal to $10^{-3}$ torr.

(Measurement of the lamp voltage characteristic)

In the above described low pressure discharge lamp, changes of the lamp voltage over time were studied as in embodiment 1. The lamp voltage at the start of uninterrupted operation of this low pressure discharge lamp during a high frequency operation at 40 kHz is roughly 150 V (effective value). Essentially, the same voltage characteristic was maintained until the duration of uninterrupted operation exceeded 9000 hours.

As becomes apparent from the above described embodiment, by means of the porous configuration of the electrode substrate, the applied amount of electrode emission material can be increased. Furthermore, by placing the electron emission material within the pores where wear is less than the wear of the electron emission material on the outside surface, wear of the electron emission material can be suppressed overall. Consequently, a low lamp voltage can be maintained over a long time and high radiant efficiency achieved over a long time.

(Embodiment 4)

In the following, an embodiment is described in which only the electrodes are changed relative to the low pressure discharge lamp according to embodiment 1.

A powder of lithium carbonate ($Li_2CO_3$) and nickel in a volumetric ratio of 1:5 is mixed. Mixing is performed under heat with stearic acid with a proportion of 0.5% by weight. In this way, granulation of the powder is achieved. Furthermore, this powder is subjected to powder molding with a compression pressure of 1 t/cm$^2$. In doing so, for example, the outside diameter is 1.4 mm, the inside diameter is 1.0 mm and the total length is 5.0 mm. This powder-molded powder is heated in a hydrogen atmosphere, vaporizing the stearic acid. Afterwards, the temperature is increased to 1000° C. and kept constant for 20 minutes. Then cooling is performed. By using sleeves for these electrodes, or in some similar manner, electrical contact with lines are established. The substrate metal of the sinter type is not limited to nickel powder. Also, the initial material for the electron emission material is not limited to lithium carbonate, but can be lithium oxide or another lithium compound. Only one example of the temperature condition is described above, without being limited thereto.

(Measurement of the lamp voltage characteristic)

In the above described low pressure discharge lamp changes of the lamp voltage over time were studied as in embodiment 1. The lamp voltage at the start of uninterrupted operation is roughly 150 V (effective value). Essentially the same voltage characteristic was maintained until the duration of uninterrupted operation exceeded 9000 hours.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

Action of the invention

As was described above, in the low pressure discharge lamp of the invention, even during uninterrupted operation, the characteristic of a low lamp voltage is maintained over a long time. High radiance can be obtained over a long time interval.

What we claim is:

1. Low pressure discharge lamp comprising a tubular glass bulb, and a pair of electrodes disposed opposite one another in the glass bulb; wherein the electrodes are provided with a lithium-containing electrode emission material comprised of a lithium-containing oxide having a molar ratio of lithium content which is at least 30% of the total metallic elements of the emission material.

2. Low pressure discharge lamp as claimed in claim 1, wherein the emission material contains at least one of the following materials: an oxide of lithium, a mixture of an oxide of lithium with another metal oxide, and an oxide which contains lithium and another metal element and which is a compound identified by the formula Li—M—$O_x$, where M designates at least one element selected from among the alkali earth metals, rare earth metals and transition metals and x designates a number of oxygen atoms required for valency equalization.

3. Low pressure discharge lamp according to claim 1, wherein said emission material is provided on the entire exterior of each of said electrodes except at a connection area of each electrode to a power supply line.

* * * * *